US009583830B2

(12) United States Patent
Stambovsky

(10) Patent No.: US 9,583,830 B2
(45) Date of Patent: Feb. 28, 2017

(54) RADIO FREQUENCY EMISSIVE DISPLAY ANTENNA AND SYSTEM FOR CONTROLLING

(71) Applicant: THE UNITED STATES OF AMERICA AS REPRESENTED BY THE SECRETARY OF THE AIR FORCE, Washington, DC (US)

(72) Inventor: Daniel W. Stambovsky, New Hartford, NY (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 499 days.

(21) Appl. No.: 14/185,956

(22) Filed: Feb. 21, 2014

(65) Prior Publication Data

US 2015/0200453 A1 Jul. 16, 2015

Related U.S. Application Data

(60) Provisional application No. 61/927,066, filed on Jan. 14, 2014.

(51) Int. Cl.
*H01Q 3/02* (2006.01)
*H01Q 3/24* (2006.01)
*H01Q 9/14* (2006.01)

(52) U.S. Cl.
CPC ..... *H01Q 3/247* (2013.01); *H01Q 9/14* (2013.01)

(58) Field of Classification Search
CPC .. G01S 7/4004; G09G 3/344; H01Q 21/0025; H01Q 3/247; H01Q 9/14
USPC ..... 342/374; 343/876
See application file for complete search history.

(56) References Cited

U.S. PATENT DOCUMENTS

| | | | | |
|---|---|---|---|---|
| 7,348,932 | B1 * | 3/2008 | Puzella | H01Q 21/0025 342/373 |
| 7,982,664 | B1 * | 7/2011 | Uscinowicz | G01S 7/4004 342/165 |
| 8,922,454 | B2 * | 12/2014 | Danesh | H01G 9/20 343/904 |
| 2006/0220948 | A1 * | 10/2006 | Fullerton | H01Q 9/28 342/118 |
| 2007/0200874 | A1 * | 8/2007 | Amundson | G09G 3/344 345/690 |
| 2012/0299765 | A1 * | 11/2012 | Huang | H01Q 3/24 342/81 |

* cited by examiner

*Primary Examiner* — Marcus Windrich
(74) *Attorney, Agent, or Firm* — Joseph A. Mancini

(57) ABSTRACT

Apparatus and method improving the performance and allowing increased directionality and bandwidth via display-like software defined antenna. A surface is composed of an array of interconnected pixels which are capable of either becoming conducting or resistive allowing arbitrarily sized and shaped antenna structures. Each pixel is controlled by biasing the base which alters the conductivity on the top portion of the pixel. The specific pattern which is active on the display style antenna is based on the desired direction, frequency range, and waveform necessary for a required transmit and receive function.

7 Claims, 7 Drawing Sheets

RADIO FREQUENCY EMISSIVE DISPLAY ANTENNA AND SYSTEM FOR CONTROLLING

PRIORITY CLAIM UNDER 35 U.S.C. §119(e)

This patent application claims the priority benefit of the filing date of provisional application Ser. No. 61/927,066, having been filed in the United States Patent and Trademark Office on Jan. 14, 2014 and now incorporated by reference herein.

STATEMENT OF GOVERNMENT INTEREST

The invention described herein may be manufactured and used by or for the Government for governmental purposes without the payment of any royalty thereon.

BACKGROUND OF THE INVENTION

This invention relates generally to software definable antennas capable of functioning across a wide range of frequency ranges and environmental conditions.

That there is a need for a software defined antenna system to pair with the growth in software based radios is well known across both government and industry. Efforts have been started through both public agencies such as DARPA as well as private, corporate entities. In order to gain the full benefit of these novel radios, flexible antenna hardware is urgently in need.

It is desirable to provide geometrically flexible antenna hardware capable of functioning efficiently across a broad range of frequencies, signal types, and environmental conditions.

An optimal solution to the problem of building communications hardware that is functional across a wide bandwidth, with variable power transmit and receive and capable of functioning in degraded or cluttered environments, is a maximally adaptive radio system. The prior art has embarked upon a quest to engineer this very approach but while it has succeeded in building a software defined (thus highly adaptive) radio, it has failed to generate an antenna system which would allow the software radio to function to its full potential. Specifically, the prior art still utilizes such standard hardware as patch antennas and as such, the prior art forms are still unable to gain full usage from these novel software defined radio systems. Additionally, the majority of the explorations into the field of reconfigurable antennas have been in one or two forms: either a short antenna which can be connected to a longer antenna section via a switch (see U.S. Pat. No. 6,195,065 B1) or narrow bandwidth antennas at the lower end of the size and power scale, leaving unaddressed the needs of larger, higher power applications.

The other background from which the motivation for this invention is drawn is nonemissive display technology as described in U.S. Pat. No. 5,930,026 and utilized in several electronic book systems. These displays utilize electrically charged ink (with opposite charges and different colors) suspended in spheres of fluid. When an electrode beneath the sphere becomes positively or negatively charged it draws a specific color of ink to the bottom of the sphere while forcing the other color to the top. In this way each sphere becomes a pixel on the display controlled by the matrix of electrodes set beneath the spheres. While these displays are quite effective at visible wavelengths they are all completely ineffective at interfering with longer wavelength radio frequencies as used in communications antennas.

OBJECTS AND SUMMARY OF THE INVENTION

It is therefore an object of the present invention to provide an apparatus that overcomes the prior art's dependency in reconfigurable antenna systems to perform precise, on-the-fly geometrical alterations to the antenna.

It is a further object of the present invention to provide "display" type antennas, capable of being any flat antenna system capable of taking on arbitrary two dimensional geometries, analogous to optical class emissive and non-emissive displays.

It is yet a further object of the present invention to provide the capability of increasing the signal to noise ratio of received signals, the directionality of both transmit and receive communications, and broadening the functional bandwidth of the antenna in dynamically changing interference environments by adapting the antenna electrical geometry in real time to maximize these capabilities.

It is still a further object of the present invention to provide novel means to selectively switch individual antenna radiating pixels into and out of a radio frequency radiating or receiving mode.

Briefly stated, the present invention, a radio frequency emissive display antenna and system for controlling it provides an apparatus for improving the performance and allowing increased directionality and bandwidth via display-like software defined antenna. A surface is composed of an array of interconnected pixels which are capable of either becoming conducting or resistive allowing arbitrarily sized and shaped antenna structures. Each pixel is controlled by biasing the base which alters the conductivity on the top portion of the pixel. The specific pattern which is active on the display style antenna is based on the desired direction, frequency range, and waveform necessary for a required transmit and receive function.

The present invention, a Radio Frequency Emissive Display (RFED) and system for controlling it, comprises in its preferred embodiment, an array of addressable pixels with microwires connecting the top of each pixel, as seen in FIG. 3, with a control mechanism. A key feature is that when a pixel is switched it becomes a conductive connection between the wires attached to the top of the pixel.

In a preferred embodiment of the present invention, an electronically directed antenna apparatus comprises an antenna having an array of radiating pixels, each capable of being switched between conductive and resistive states so as to permit and inhibit radio frequency radiation, respectively, therefrom as well as an antenna control subsystem that cooperates with the antenna, a radio frequency source, and a data source to enable switching of the pixels.

In the preferred embodiment, the radiating pixels comprise a pixel, a biasing element, and a column comprising a switching element where the biasing element receives control signals and transmits state signals to the antenna control subsystem.

In alternate embodiments, the radiating pixels replace the biasing element with alternative means for switching the pixel into a conductive state.

The present invention is capable of an extremely wide range of antenna geometries and on-the-fly signal maximization and has the flexibility for use in highly mobile applications where weight is a major factor. It would be most apt for applications requiring flat profile, quick response directionality and multi-band capability as in high-performance military aircraft, for example. The dynamic capabilities of the present invention would enhance mitigation of atmospheric and environmental signal distortions and degradations, while providing a high degree of angular directivity. Additionally, the present invention could be layered, and if properly controlled in parallel, would yield three dimensional (although still flat surfaced) antenna geometries.

There are a variety of possible embodiments of the present invention, most having to do with the mechanism for activation of each pixel once selected for conductivity. In non-emissive displays the switching system relies on charged ink which moves to the bottom and top of each pixel (see above mentioned patent). The emissive display proposed here must function quite differently to produce a conductive surface with similar responsiveness as its non-emissive counterpart.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

The preferred embodiment is the initially described reflecting system seen in FIG. 1 through FIG. 4.

Figure 1:
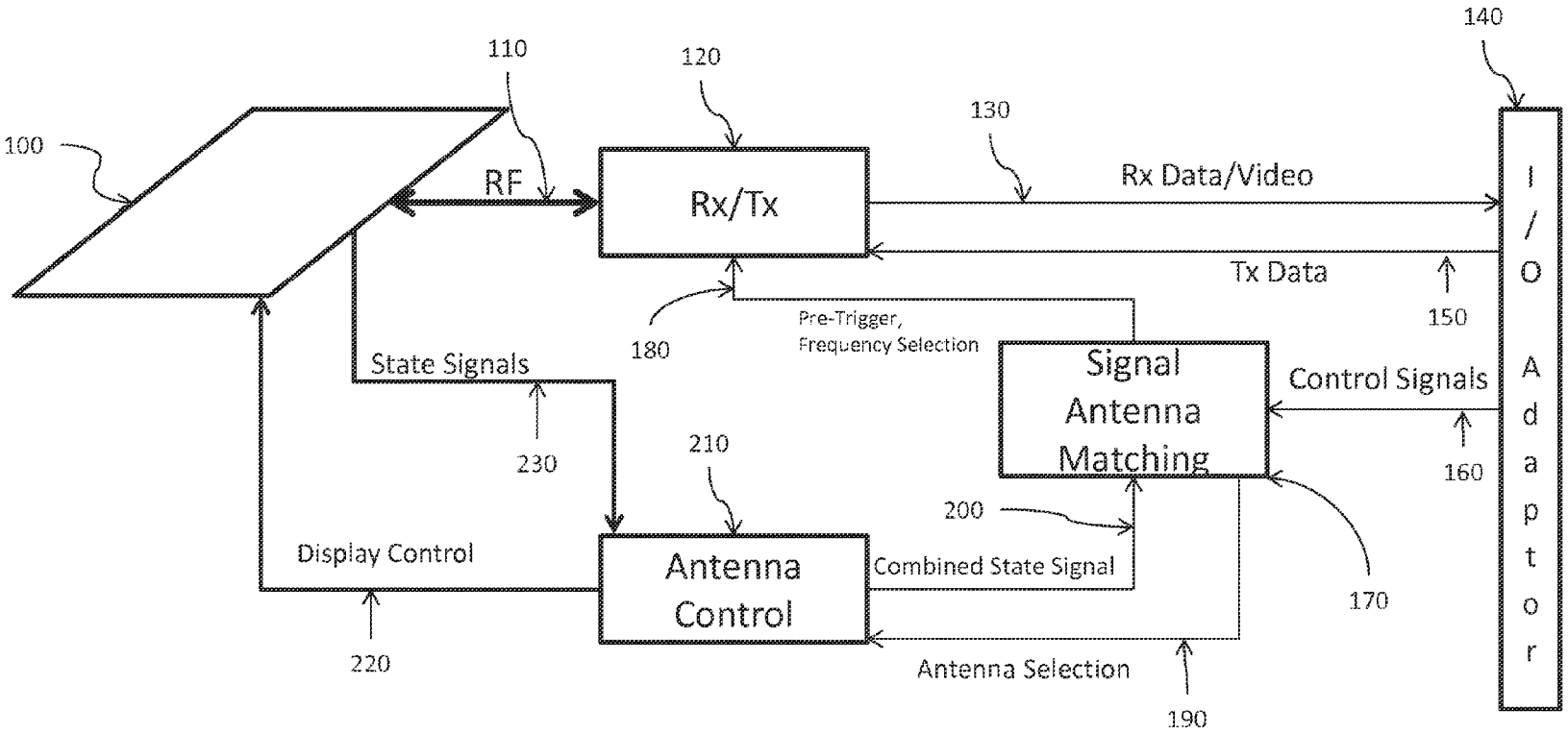
FIG. 1 is a schematic diagram representation of the present invention including transmit and receive and control modules.

FIG. 1 shows a detail of the overall system comprising the present invention. The present invention's antenna 100 requires sources of input from an RF source such as the RF coming from the transmitter (Tx) portion of the Receive-Transmit (Rx/Tx) 120 module, and the Display Control Signals 220 coming from the Antenna Control Module 210. The Rx/Tx 120 module can be any of a number of systems capable of receiving and transmitting across a wide bandwidth and a large variety of waveforms (e.g. TR Modules, Traveling Wave Tube amplifiers, etc.). Software radio applications of the present invention, and perhaps some radar applications, would require RF connections to and from an RF receiver/transmitter. Both the outgoing data to be transmitted 150 and the received data 130 from the present invention's antenna 100 are fed through the Input/Output (I/O) Adaptor 140 which ensures proper connection between the present invention and the rest of the system to which it is attached (i.e. an aircraft or ground vehicle). The I/O Adaptor 140 also provides the control signals to the Signal Antenna Matching (SAM) 170 module. This module is responsible for aligning the antenna 100 with the desired Rx/Tx requirements. In order to do so, it accepts Control Signals 160 from the I/O Adaptor 140 which includes the desired direction, waveform, and the frequency band that needs to be utilized. I/O Adaptor 140 typically interfaces with some form of data source such as a computer (not shown) under autonomous or interactive software control and from which control signals and commands originate. The SAM 170 module then determines the proper antenna geometry to be utilized and generates an appropriate Antenna Selection 190 signal to send to the Antenna Control 210. The SAM 170 module is also responsible for ensuring time alignment between the present invention's antenna 100 and the Rx/Tx 120 system, thus ensuring the proper geometry is in place on the present invention's antenna 100 before the Rx/Tx 120 tries to operate. To perform this alignment the SAM 170 reads the current state of the present invention's antenna 100 from the Combined State Signal 200 passed along from the Antenna Control 210 and utilizes this information to generate the Rx/Tx Pre-Trigger, which along with the Frequency Selection signal, is sent via signal path 180 to the Rx/Tx module 120. The Antenna Control 210 performs two basic functions: converting the Antenna Selection 190 signal to appropriately routed Display Control 220 signals to switch individual RFED 100 pixels, and amalgamation of the separate State Signals 230 into a Combined State Signal 200 for the SAM 170. Antenna Control 210, Display Control 220, Signal Antenna Matching (SAM) 170, and I/O Adaptor 140 are functionally and collectively referred to as an antenna control subsystem.

Figure 2:
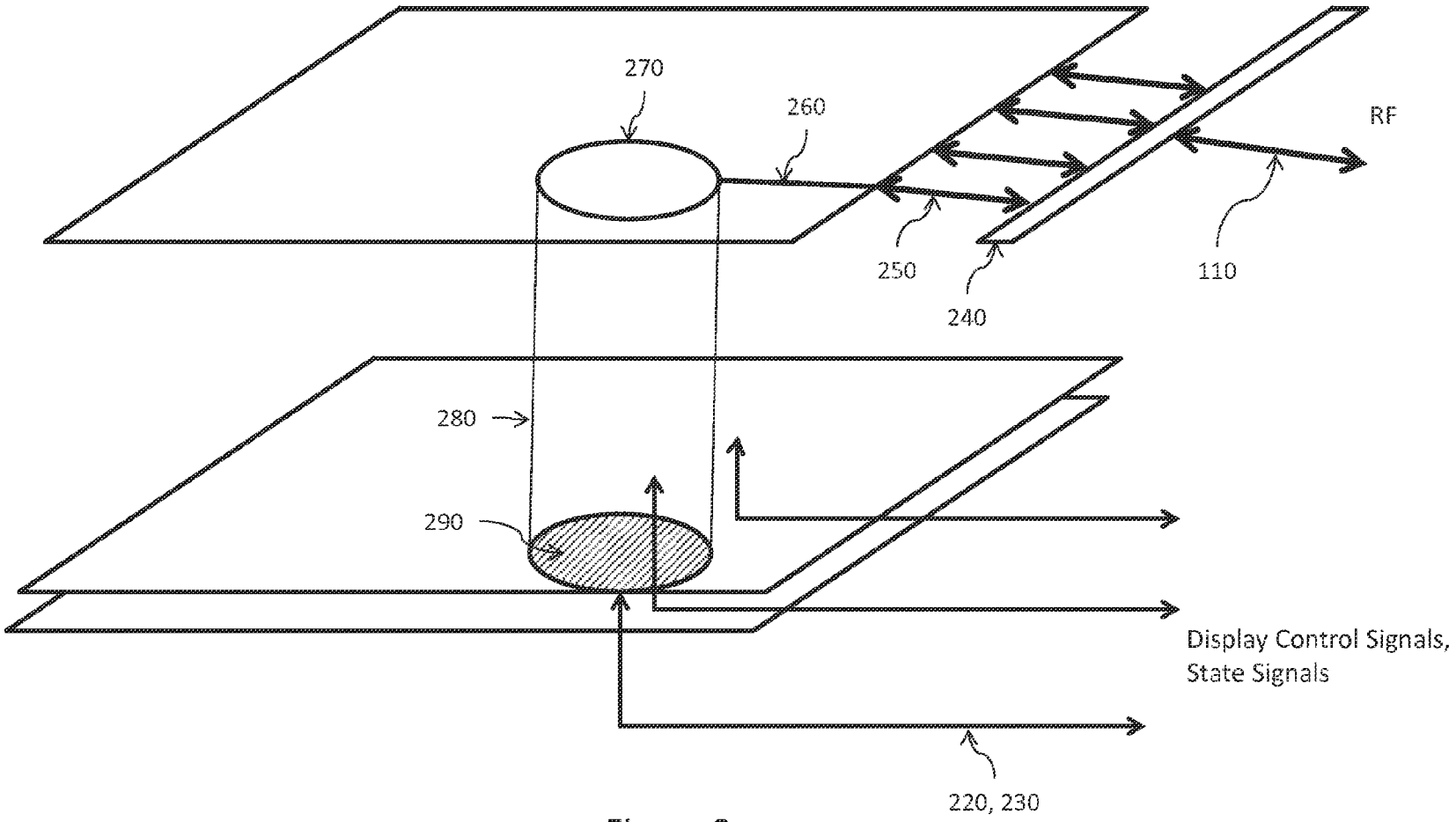
FIG. 2 is a schematic diagram representation of the interconnection between the RFED antenna and the control and radio frequency (RF) pathways of the present invention.

FIG. 2 shows the interconnections between the present invention's antenna 100 and the other modules. At the top of the diagram, the RF signals 110 from both the Tx and Rx is shown entering and leaving the antenna via the Splitter/Combiner 240 which distributes the Tx RF signals to the elements of the present invention's antenna array 100 and combines the Rx signals to a single output (the RF going to and from each segment of the array is seen in 250). The RF signals are conducted along wires 260 to the radiating pixels 270 which when activated, are conducting. The column 280 contains the mechanism to switch the pixel 270 several alternate embodiments which are described below. While the shape column 280 is shown in the attached diagrams as cylindrical, it need not be. Shown at the bottom of FIG. 2 are the Display Control Signal 220 inputs and the State Signal outputs 230 seen connecting to the Biasing Element 290 which is used to power the pixel switching element 290. This control system functions in a manner similar to non-emissive displays, and would be modeled on them.

Figure 3:
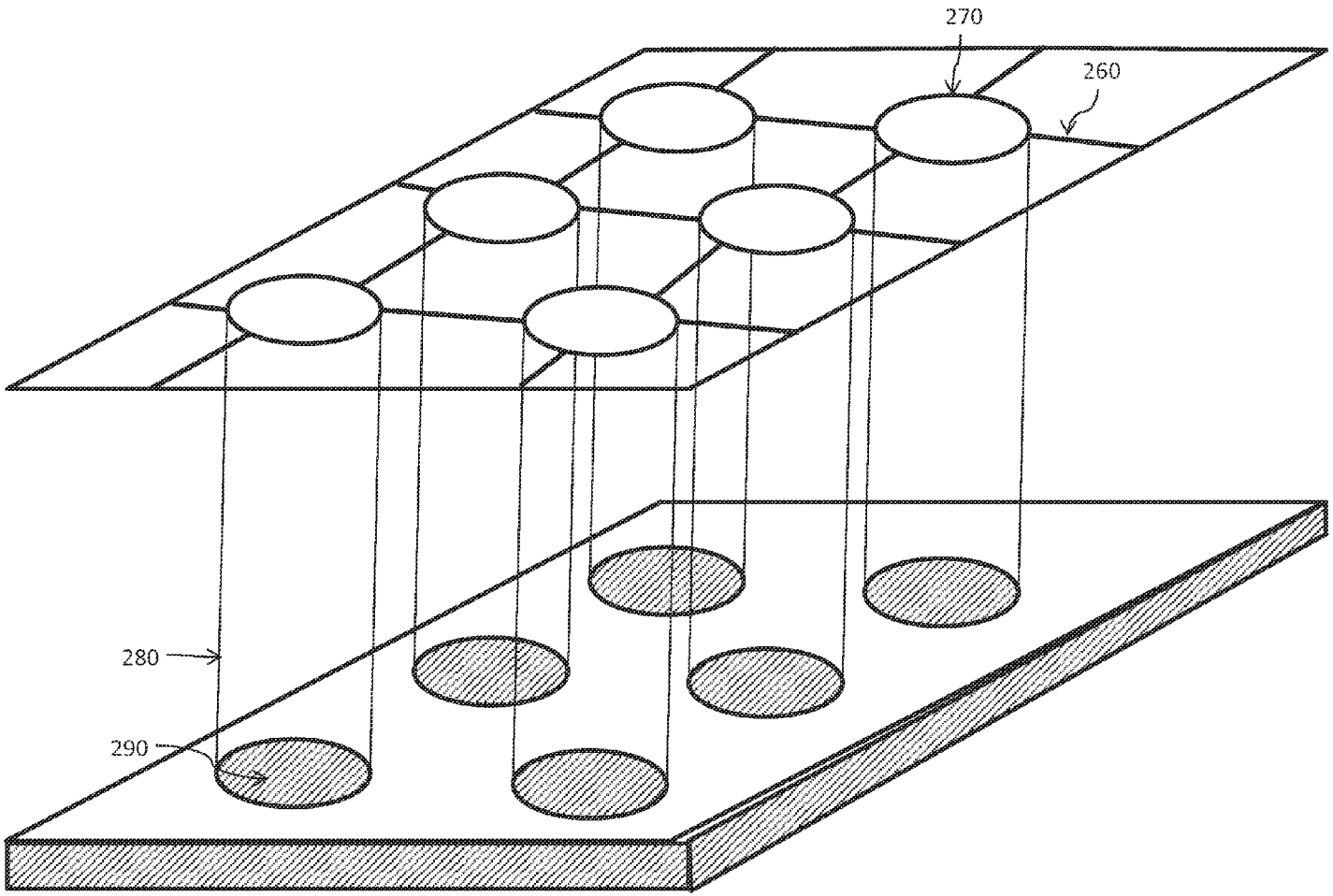
FIG. 3 is a schematic diagram representation showing the array system of the pixels in the present invention.

FIG. 3 shows how all of the pixels 270 are arranged and interconnected using the wires 260. The shape of the conducting portion of the array is constructed by switching the proper arrangement of pixels 270 into a conducting mode, while ensuring that the others are simultaneously non-conducting.

Figure 4:
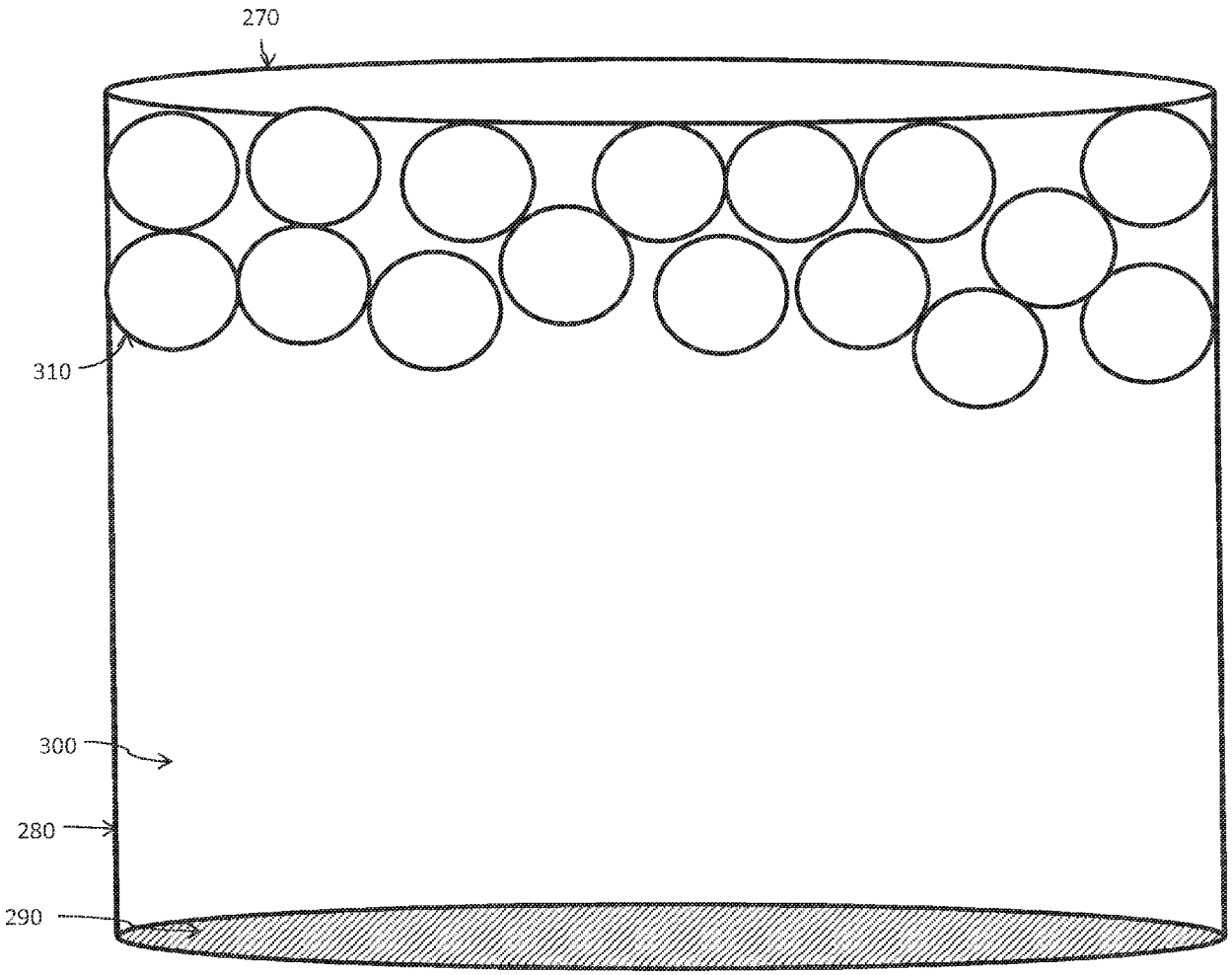
FIG. 4 is a schematic diagram showing the preferred embodiment of the present invention, further depicting an individual pixel with its set of charged, nonconductive displacers.

FIG. 4 through FIG. 7 shows a series of alternate embodiments of the pixel 270 switching elements which are contained in the cylinders 280. One alternate embodiment is shown in FIG. 4 in which the cylinder 280 contains a conducting fluid 300 in which are suspended charged, non-conducting spheres 310. The spheres are forced towards the top of the cylinder 280 when the Biasing Element 290 is biased with the same charge as the spheres. These non-conducting spheres then displace the conducting fluid 300 from the pixel 270 thereby greatly decreasing the conductivity across the pixel. When the Biasing Element 290 has a charge opposite of the spheres 310 it draws them to the bottom of the cylinder 280 thereby increasing the conductivity across the pixel 270. Note that the non-conducting displacing elements 310 need not be spherical as shown in FIG. 4, but rather should be shaped in such a way as to achieve the best displacement of the conducting fluid 300 while still moving effectively in response to the charge on the Biasing Element.

Figure 5:
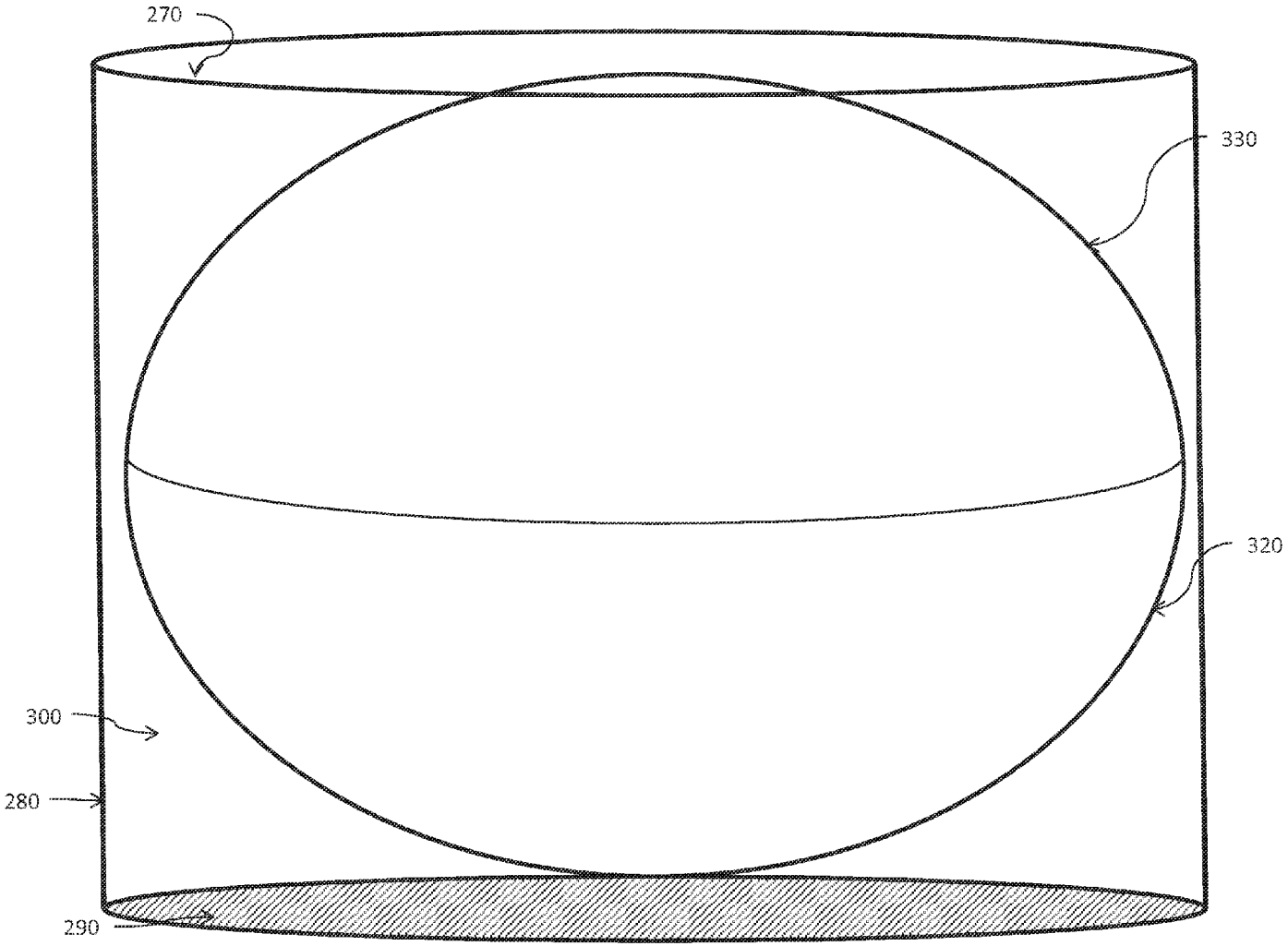
FIG. 5 is a schematic diagram showing an alternative embodiment of the present invention having an individual pixel utilizing a bimodal sphere.

FIG. 5 shows another alternate embodiment of the pixel 270 switching elements in which a cylinder 280 contains a sphere which itself is composed of two sections: a conducting hemisphere 330 and a charged, non-conductive hemisphere 320. In this embodiment, the Biasing Element 290 is used to rotate the sphere so that either the conducting portion 330 or non-conducting 320 hemisphere is touching the pixel 270 thereby increasing or decreasing its conductivity.

Figure 6:
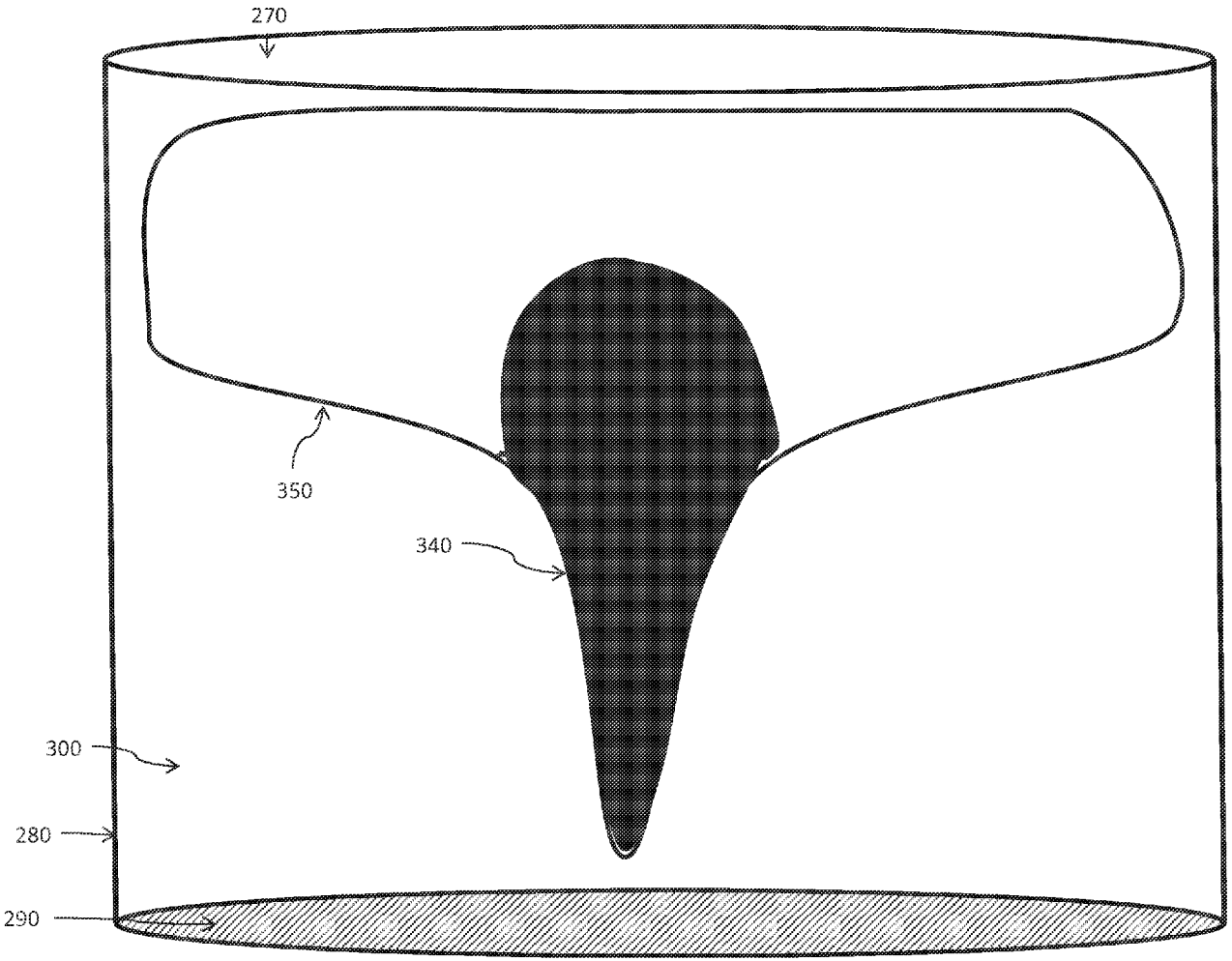
FIG. 6 is a schematic diagram showing another alternative embodiment of the present invention having an individual pixel utilizing a bimodal plunger.
Figure 7:
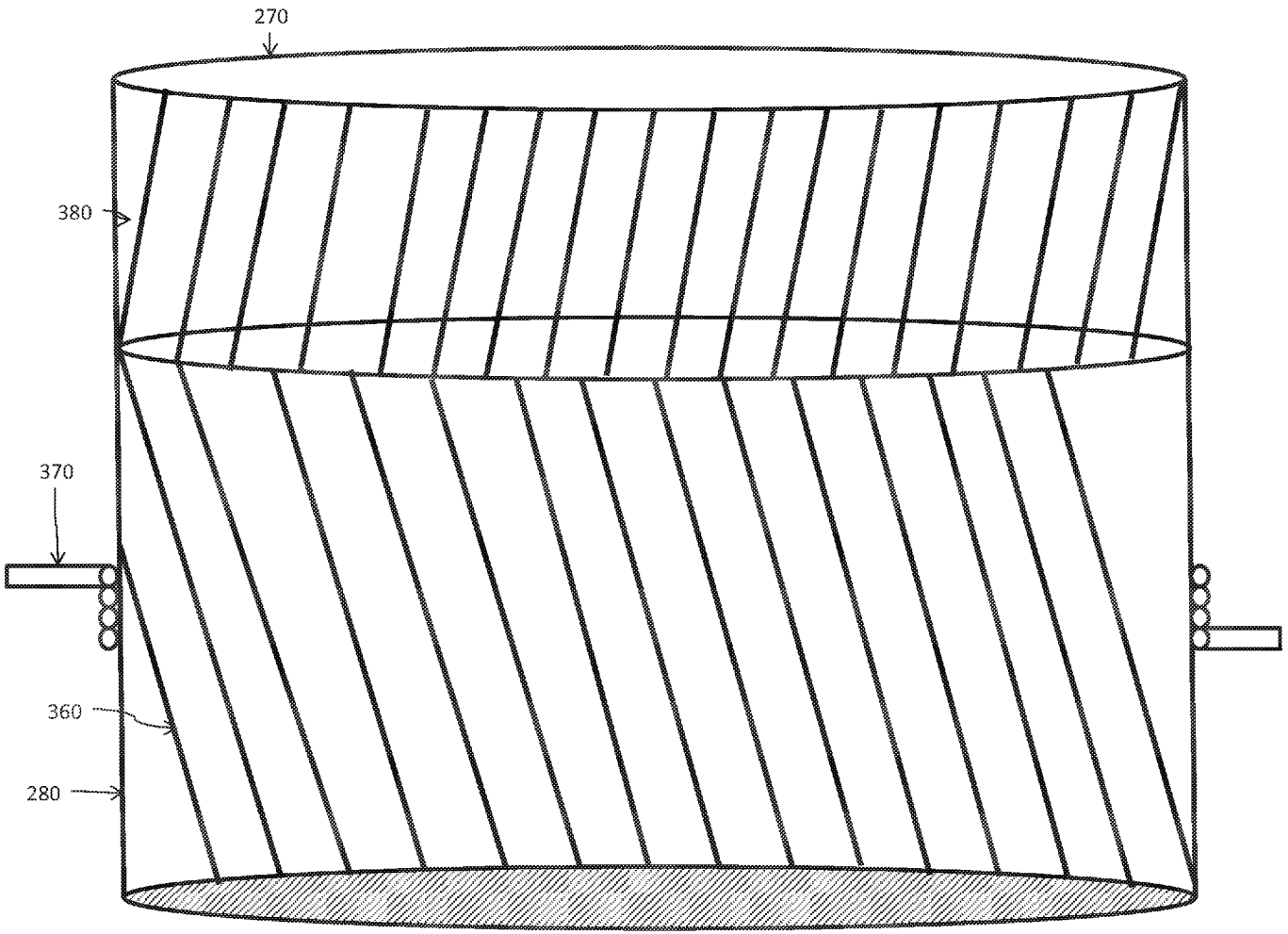
FIG. 7 is a schematic diagram showing another alternative embodiment of the present invention having an individual pixel utilizing a ferro-fluid and a piezoelectric cap.

FIG. 6 depicts yet another alternate embodiment of the pixel 270 switching element but instead of a sphere, there is a bi-modal plunger composed of a broad head conducting element 350 and a smaller non-conductive charged tail 340. In this set-up the Biasing Element 290 moves the plunger up and down the cylinder 280 using the charged tail. FIG. 7 depicts still yet another alternate embodiment of the pixel 270 switching element. It is composed of two sections, the portion of the cylinder 280 adjacent to pixel 270 is composed of a material 380 which becomes conducting to varying amounts under physical pressure, such as a piezoelectric material. Below that is a hollow filled with ferrofluid 360 which produces the force on the upper portion of the cylinder 280. Instead of the Biasing Element 290 (not present in this alternate embodiment) seen in the other figures, the control mechanism is a small wire wrap 370 which generates a magnetic field through the ferrofluid 360. When current is sent through the wire wraps 370 the ferrofluid 360 attempts to align itself to the field, in so doing it applies force to the top portion of the cylinder 280, allowing it to become conducting.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electronically directed antenna apparatus, comprising:

an antenna having an array of radiating pixels, each capable of being selectively switched between conductive and resistive states so as to permit and inhibit radio frequency radiation, respectively, therefrom; and an antenna control subsystem, wherein said antenna control subsystem cooperates with said antenna, a radio frequency source; and a data source so as to enable said selective switching;

wherein each of said radiating pixels further comprises a pixel;

a biasing element; and a column comprising a switching element;

wherein said biasing element receives control signals and transmits state signals to said antenna control subsystem;

causes said switching element to switch said pixel into conducting and non-conducting states; and causes said switching element to vary the conductance of said pixel from a conducting to non-conducting states; and wherein said switching element is a sphere in physical contact with said pixel, said sphere having two hemispheres further comprising a conducting hemisphere and a non-conducting hemisphere.

2. The apparatus of claim 1, wherein said biasing element causes said sphere to rotate on command so as to place either said conducting or said non-conducting hemisphere into contact with said pixel.

3. The apparatus of claim 1, wherein said switching element is a plunger having an electrically conductive upper surface and an electrically charged, non-conductive lower surface.

4. The apparatus of claim 3, wherein said biasing element causes said plunger to move toward said pixel so as to place said conductive upper surface into electrical contact with said pixel on command; and to move away from said pixel so as to break electrical contact with said pixel on command.

5. The apparatus of claim 1, wherein each of said radiating pixels further comprises a pixel;

a magnetic field inducing means; and a column comprising an upper section and a lower section, wherein said upper section further comprises a pressure-induced conducting medium; and said lower section comprises a ferro-fluid;

wherein said magnetic field inducing means receives control signals and transmits state signals to said antenna control subsystem.

6. The apparatus of claim 5, wherein said ferro-fluid applies force on said pressure-induced conducting medium in response to an induced magnetic field from said magnetic field inducing means; and said pressure-induced conducting medium becomes electrically conductive in response to said applied force.

7. The apparatus of claim 6, wherein said magnetic field inducing means comprises a wire wrapped around said lower section of said column.

* * * * *